US008640358B2

(12) United States Patent
DeMarco et al.

(10) Patent No.: US 8,640,358 B2
(45) Date of Patent: Feb. 4, 2014

(54) FREEZE DRYER SLOT DOOR ACTUATOR AND METHOD

(75) Inventors: Francis W. DeMarco, Niagara Falls, NY (US); Ernesto Renzi, Youngstown, NY (US)

(73) Assignee: Ima Life North America Inc., Tonawanda, NY (US)

( * ) Notice: Subject to any disclaimer, the term of this patent is extended or adjusted under 35 U.S.C. 154(b) by 365 days.

(21) Appl. No.: 13/131,949

(22) PCT Filed: Dec. 15, 2009

(86) PCT No.: PCT/US2009/006559
§ 371 (c)(1), (2), (4) Date: May 31, 2011

(87) PCT Pub. No.: WO2010/074723
PCT Pub. Date: Jul. 1, 2010

(65) Prior Publication Data

US 2011/0232123 A1 Sep. 29, 2011

Related U.S. Application Data

(60) Provisional application No. 61/203,441, filed on Dec. 22, 2008.

(51) Int. Cl.
*F26B 11/02* (2006.01)

(52) U.S. Cl.
USPC ..... 34/284; 34/287; 134/115 R; 198/457.07; 414/287; 242/397.5; 312/312

(58) Field of Classification Search
USPC ..... 34/284, 287, 381, 413, 497, 90, 92; 134/18, 115 R; 198/429, 432, 457.07; 414/214, 287, 18; 242/397, 397.5, 566; 312/292, 312
See application file for complete search history.

(56) References Cited

U.S. PATENT DOCUMENTS

| | | | | |
|---|---|---|---|---|
| 3,307,517 | A | 3/1967 | Rasmusson | |
| 3,469,327 | A | 9/1969 | Janovtchik | |
| 3,537,233 | A | 11/1970 | Costello | |
| 3,775,942 | A * | 12/1973 | Powell et al. | 53/264 |
| 4,142,303 | A * | 3/1979 | Fraser | 34/92 |
| 4,325,193 | A * | 4/1982 | Thompson | 34/92 |

(Continued)

FOREIGN PATENT DOCUMENTS

| | | | |
|---|---|---|---|
| DE | 20313944 U1 | 1/2005 | |
| EP | 834457 A1 * | 4/1998 | B65D 51/24 |

(Continued)

OTHER PUBLICATIONS

STIC search translation request for IDS submission JP 2006-226633 on Dec. 19, 2013.*

(Continued)

*Primary Examiner* — Steve M Gravini

(57) ABSTRACT

Movement of a slot door of a freeze dryer is driven by a rack and pinion actuator. The actuator is easily sanitized and includes internal elements that are accessible to sanitizing sprays. The pinions are driven by pinion shafts that pass through a seal separating an aseptic area from a non-aseptic area where the drive train is positioned. Only rotary motion is transferred across the aseptic barrier, reducing the need for a bellows or sliding covers, which are difficult to sanitize.

21 Claims, 6 Drawing Sheets

(56) References Cited

U.S. PATENT DOCUMENTS

| | | | | |
|---|---|---|---|---|
| 4,503,656 | A * | 3/1985 | Hautemont | 53/396 |
| 5,387,040 | A | 2/1995 | Firestone | |
| 5,649,800 | A | 7/1997 | Hemmersbach et al. | |
| 5,715,611 | A | 2/1998 | Jacobs | |
| 6,564,471 | B1 * | 5/2003 | Sutherland et al. | 34/284 |
| 7,076,888 | B2 * | 7/2006 | Damen et al. | 34/92 |
| 7,292,907 | B2 * | 11/2007 | Whaite et al. | 700/159 |
| 7,343,696 | B2 * | 3/2008 | Covert | 34/92 |
| 7,762,383 | B2 * | 7/2010 | Damen | 198/429 |
| 8,235,640 | B2 * | 8/2012 | Balboni et al. | 414/222.12 |
| 2006/0207122 | A1 | 9/2006 | Stewart | |
| 2008/0236621 | A1 | 10/2008 | Lin | |

FOREIGN PATENT DOCUMENTS

| | | | | |
|---|---|---|---|---|
| EP | 09835379.0 | | 2/2013 | |
| GB | 2020252 | A * | 11/1979 | B65D 51/18 |
| GB | 2424263 | A | 9/2006 | |
| JP | 02157587 | A * | 6/1990 | |
| JP | 03120871 | A * | 5/1991 | |
| JP | 3-120871 | | 12/1991 | |
| JP | 03280906 | A * | 12/1991 | |
| JP | 2000-344096 | A | 12/2000 | |
| JP | 2006-226633 | A | 8/2006 | |
| WO | WO 2005000703 | A2 * | 1/2005 | B65D 51/24 |
| WO | WO2005088216 | | 9/2005 | |
| WO | WO2006008471 | | 1/2006 | |
| WO | 2008057383 | A2 | 5/2008 | |
| WO | 2008057383 | A3 | 5/2008 | |
| WO | WO 2008112155 | A1 * | 9/2008 | |

OTHER PUBLICATIONS

STIC search translation request for IDS submission JP 3-120871 on Dec. 19, 2013.* machine translation JP 2006-226633 on Dec. 19, 2013.* machine translation JP 3-120871 on Dec. 19, 2013.*

Japanese (Equivalent) Patent Application 2011-543494 Office Action dated Oct. 7, 2013.

* cited by examiner

FREEZE DRYER SLOT DOOR ACTUATOR AND METHOD

CROSS REFERENCE TO RELATED APPLICATIONS

This application claims priority to U.S. Provisional Patent Application Ser. No. 61/203,441, filed Dec. 22, 2008, and entitled "Freeze Dryer Slot Door Actuator and Method."

FIELD OF THE INVENTION

The present invention relates to an apparatus and method for operating a slot door of a freeze dryer chamber or the like, and to a freeze dryer incorporating such an apparatus.

BACKGROUND OF THE INVENTION

Freeze drying is a process that removes water from a product in the form of ice. In a freeze drying process, the product is frozen and, under vacuum, the ice sublimes and the resulting vapor flows towards a condenser. Ice subsequently condensed on the condenser is removed in a later stage. Freeze drying is particularly useful in the pharmaceutical industry, as the integrity of the product is preserved during the freeze drying process and product stability can be guaranteed over relatively long periods of time.

Freeze dryers have a vacuum chamber for receiving a plurality of containers or vials containing the product to be freeze dried. The chamber usually includes a number of shelves, which can be raised and lowered within the chamber. To load the shelves, the shelves are initially moved to the lower portion of the chamber, with the uppermost shelf in a loading position. After that shelf has been loaded, the mechanism automatically raises the shelves to permit the next shelf to be moved to the loading position. The moving sequence continues until the chamber loading has been completed. To unload the chamber, the loading sequence is reversed, with the lowermost shelf being unloaded first.

Access to the chamber for automated loading and removal of product is through a rectangular opening, or slot, formed in a wall or in a main door of the chamber. A moveable slot door closes the slot. To permit vials of product to be inserted into the chamber, the slot door is vertically raised relative to the slot by moving the slot door along guide tracks.

Various techniques have been used in loading and unloading vials in the chamber. In one arrangement, a mechanism pushes vials onto a shelf in the chamber from a conveyor belt running parallel with the slot. The vials may be loaded from the conveyor belt row by row onto a shelf. Another loading technique utilizes a wheeled transfer cart that moves on rails. The transfer cart may carry an entire shelf of vials at a time, which may be pushed onto the shelf in the chamber in a single loading operation. After a shelf is completely loaded, the shelf is raised and another is moved into position for loading. Once loading has been completed, the slot door is lowered to close the slot and enable the chamber to be evacuated for subsequent freeze drying of the contents of the vials.

Several actuation mechanisms have been used to move the slot door of a freeze drying chamber between the open and closed positions. In one arrangement, one or more lead screws or ball screws are used to raise and lower the slot door in its guide tracks. The screws are arranged on either side of the slot door. In another arrangement, one or more pneumatic or hydraulic piston actuators are used to raise and lower the slot door.

The slot door and its actuation mechanism reside in a class 100, or class A, sanitary clean room environment. In some applications, one or more of the loading and door actuation components, together with the chamber opening, may reside in an isolator that contains a sterile environment, the isolator allowing the room it is located in to have less stringent cleanliness requirements, such as class C.

The chamber, slot door and actuation mechanism must periodically be sanitized or sterilized to maintain the environment. Both screw-type and piston-type actuators include internal mechanisms that are not easily sanitized using direct chemical or steam sanitizing techniques. For example, ball screws contain ball bearings, ball recirculation tracks and internal ball grooves that cannot easily be sanitized without disassembly. Similarly, the threads of a lead screw and the cylinder rod, cylinder wall and piston of a hydraulic or pneumatic actuator are not easily accessed for sanitization.

To maintain the aseptic nature of the clean environment, those linear actuation mechanisms may be placed outside the clean environment. In that case, a link having a linear motion must traverse the barrier between the clean processing environment and the external, ambient environment. The barrier must therefore incorporate a moveable seal such as a flexible bellows or a sliding cover to permit movement while enclosing the sanitary environment. Both the bellows and the sliding covers have shortcomings. Bellows are difficult to sanitize manually because they present an internal geometry with numerous corrugations. That especially presents challenges in applications where sanitization is done by spraying. Sliding covers also present problems inasmuch as they move into and out of the sanitary environment and cannot be hermetically sealed.

There therefore remains a need for a slot door actuation method and apparatus with improved characteristics for maintaining a clean environment.

SUMMARY

The present disclosure addresses the needs described above by providing systems and methods relating to the operation of a slot door of a freeze drying chamber. One embodiment described herein is a freeze dryer system having an aseptic area and a non-aseptic area. The system includes a vacuum chamber and a slot door for providing access through an opening in the vacuum chamber by sliding between open and closed positions, the slot door being in the aseptic area in both the opened and closed positions. At least one gear rack is connected to the slot door, the gear rack being within the aseptic area of the system. For each gear rack, a pinion is engaged with the gear rack for driving the gear rack to move the slot door between the open and closed positions, the pinion being within the aseptic area.

The freeze dryer system may further include at least one pinion drive shaft for driving the at least one pinion in a rotary motion, the at least one pinion drive shaft passing through a rotary seal separating the aseptic area of the system from the non-aseptic area. That arrangement may further include a drive means connected for rotating the drive shafts and pinions, the drive means being in the non-aseptic region of the system. The drive means may comprise first and second right angle drives coupled to respective pinion drive shafts; a shaft coupling the right angle drives for synchronous rotation; and a motor coupled for driving the right angle drives.

The freeze dryer system may further comprise an automated system for sanitizing at least the gear racks and pinions in the aseptic area. The system may deliver a cleaning agent such as vaporized hydrogen peroxide, bleach or steam. The slot door may be spaced apart from a wall of the vacuum chamber by an extension surrounding the opening in the vacuum chamber. The system may further include a loading mechanism positioned for loading product through the opening in the vacuum chamber, the loading mechanism being at least partially within the aseptic area. Guards may be positioned over the at least one gear rack and pinion, the guards being manually removable for sanitizing the gear and pinion.

Another embodiment disclosed herein is a method is for the operation of a slot door in an aseptic environment. A pinion drive shaft is sealed with a sanitary seal for keeping a pinion end of the drive shaft aseptic while a drive end of the drive shaft is not aseptic. At least the following elements are then sanitized: a pinion mounted on the pinion end of the pinion drive shaft, a gear rack attached to the slot door and in engagement with the pinion, and the slot door. The drive end of the drive shaft is then driven to rotate the pinion, drive the gear rack and operate the slot door.

The sanitizing step may further comprise spraying a sanitizing agent on the elements of the freeze drying chamber. The sanitizing agent may include vaporized hydrogen peroxide, a bleach agent or steam. The step of sealing may include applying a lip seal or a packing. The pinion drive shaft may be driven through a right angle drive mechanism.

Another embodiment is a freeze dryer system that comprises a vacuum chamber having a vacuum chamber opening for loading product into the vacuum chamber. A slot door is mounted for substantially linear movement between an open position for loading product through the vacuum chamber opening and a closed position for sealing the vacuum chamber opening. At least one gear rack is connected to the slot door. For each gear rack, a pinion is engaged with the gear rack for driving the gear rack to move the slot door between the open and closed positions.

The freeze dryer system may further include a loading mechanism positioned for loading product through the vacuum chamber opening. At least one guard may be positioned over the at least one gear rack and pinion, the guards being removable for sanitizing the gear rack and pinion. Each pinion may have an axis of rotation substantially perpendicular to a plane of the slot door.

DESCRIPTION OF THE INVENTION

The apparatus and method of the present invention overcome the problems inherent in the prior art by operating the slot door with a mechanism having exposed components that are easily sanitized using standard automated or manual techniques. The invention furthermore eliminates a need for a bellows or sliding cover by eliminating the need to traverse the sanitary barrier with an actuator having linear movement.

Figure 1A:
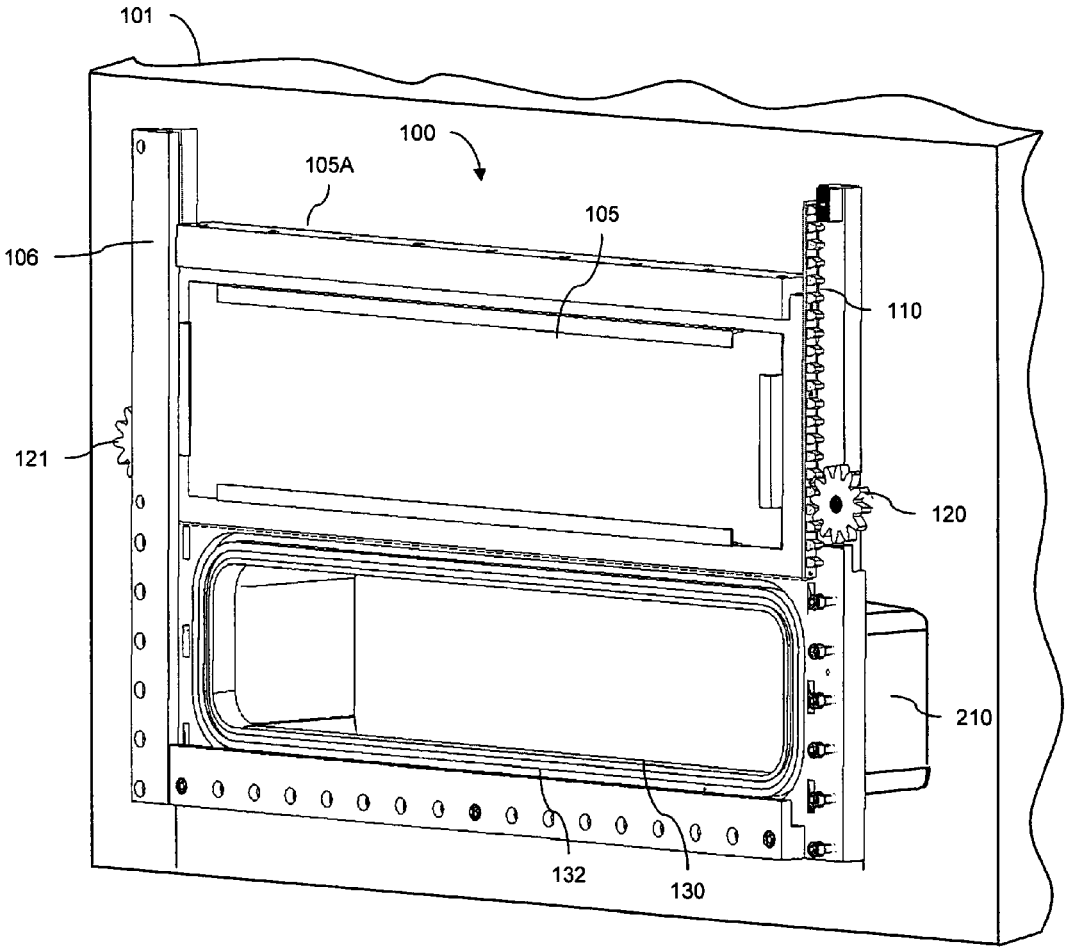
FIG. 1A is a partial view of a door and actuating system of the invention with a chamber door in an open position.
Figure 1B:
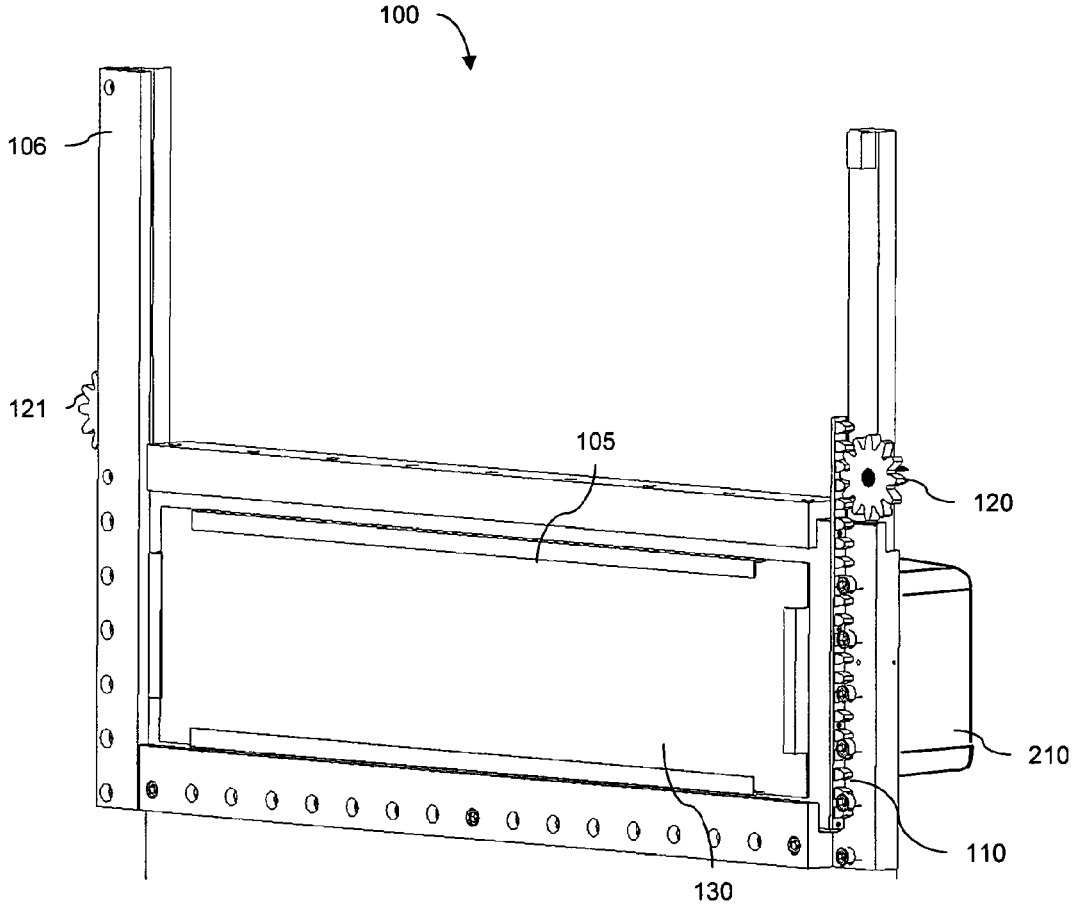
FIG. 1B is a partial view of a door and actuating system of the invention with a chamber door in a closed position.

A vacuum chamber slot door and door operating mechanism 100 in accordance with the invention is illustrated in FIGS. 1A & 1B. The mechanism 100 provides access to a vacuum chamber opening 130 through which materials to be freeze dried are loaded into a vacuum chamber 101. In the embodiment shown, the mechanism 100 is spaced away from a front wall of the vacuum chamber 101 by an extension 210, as further described elsewhere in this disclosure with reference to FIGS. 2A and 2B.

The opening 130 is opened and closed by raising and lowering a slot door 105, which is shown in an open position in FIG. 1A and in a closed position in FIG. 1B. In the closed position, the slot door 105 contacts door seals 132 (FIG. 1A) to maintain a vacuum or positive pressure in the chamber.

A pair of door guides 106 on either side of the door 105 constrains the door for translation in a linear sliding motion between the open and closed positions. In addition, the guides restrain the door when the chamber is placed under positive pressure during sanitization or sterilization. In the illustrative figures, the door guide on the right side has been removed to more clearly show the underlying components. The slot door 105, together with the actuation mechanism described below, are maintained in a sanitary environment so that the door may be opened and closed, and materials may be loaded and unloaded, without contaminating the materials.

A gear rack 110 is fixed to a side of the slot door 105. A similar gear rack is fixed to the opposite side of the slot door 105 and is not visible in FIGS. 1A & 1B beneath the guide 106. The gear racks 110 may be fabricated from a non-corroding metal such as stainless steel or from a resin suitable for use in a sanitary or sterile environment. Each gear rack comprises a plurality of gear teeth. Each tooth may have a straight tapered shape for meshing with involute pinion teeth as described below.

The gear racks 110 move with the slot door 105. As can be clearly seen in the figures, the gear racks 110 do not extend excessively beyond the top edge 105A of the slot door 105. The gear racks 110 are furthermore contained entirely within the aseptic environment, so no flexible bellows or sliding cover is necessary to transmit linear motion across the aseptic barrier.

Rotating pinion gears 120, 121 mesh with the gear racks 110 located on the sides of the slot door, and drive the linear motion of the door. The pinions 120, 121 have a plurality of teeth that may have an involute tooth profile to maximize efficiency in meshing with and driving the racks. In a preferred embodiment, one rack and pinion assembly is positioned on each side of the door. The rotary motion of the two pinions 120, 121 is synchronized to assure even tracking of the door in its linear motion.

The pinions 120, 121 and racks 110 are exposed within the aseptic area to provide access for spraying with a sanitizer solution. Unlike ball screws, lead screws, hydraulic or pneumatic cylinders and most other actuation mechanisms, the rack and pinion arrangement has no internal parts that are inaccessible without disassembly. The interface between the rotating pinion and linear rack may be left open for spray sanitization, either automated or manual. Alternatively, the components may be guarded against incidental contact, using guards that are easily removed for spray or steam sanitization. For example, the door guide 106 may incorporate quick removal and replacement features. The resulting assembly is easily sanitized or sterilized without major disassembly of the components.

The pinions 120, 121 are driven by drive shafts coupled to the pinions at the rotational axes of the pinions. In the embodiment shown in FIGS. 1A & 1B, the pinions 120, 121 are arranged with their axes of rotation perpendicular to the plane of the slot door 105. Separate drive shafts drive the two pinions and are synchronized as described below. In an alternative embodiment (not shown), the two pinions rotate on a single axis of rotation that is parallel to the plane of the slot door 105. In that embodiment, a single shaft may couple the two pinions.

Figure 2A:
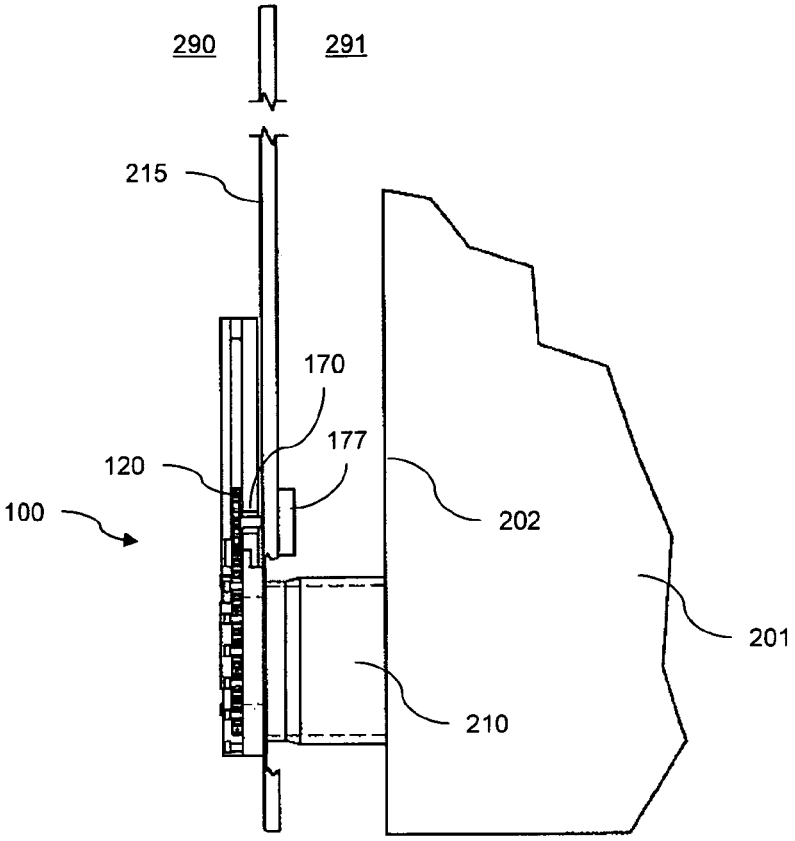
FIG. 2A is a side elevation view of a door and chamber in accordance with the invention.
Figure 2B:
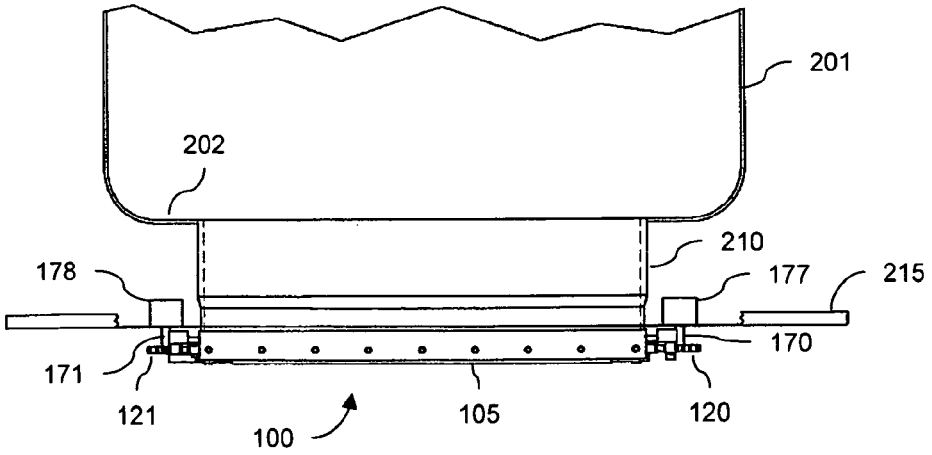
FIG. 2B is a top view of a door and chamber in accordance with the invention.

A slot door nozzle or extension 210 is shown in FIGS. 2A & 2B, which illustrate side elevation and top views of the chamber, respectively. The extension 210 extends from a wall 202 of the chamber 201 to a bezel 215 that separates an aseptic area 290 from a non-aseptic area 291 (FIG. 2A) of the freeze drying system. The extension 210 surrounds the opening 130 (FIG. 1A) of the vacuum chamber 201, and isolates the aseptic interior of the chamber from the non-aseptic area 291.

The door operating mechanism 100 is mounted on an end of the extension 210 opposite the wall 202 of the chamber 201, and operates the door 105. The pinions 120, 121 are driven by drive shafts 170, 171 that pass through the bezel 215. Drives 177, 178 drive the drive shafts 170, 171 from the shaft ends opposite the pinions 120, 121. At a location intermediate the pinion end and the drive end, the drive shafts 170, 171 are sealed to the bezel 215 by a rotary seal such as a lip seal or a packing. Contaminants on the non-aseptic side 291 of the bezel 215 are thereby prevented from contaminating the aseptic side 290.

Figure 3:
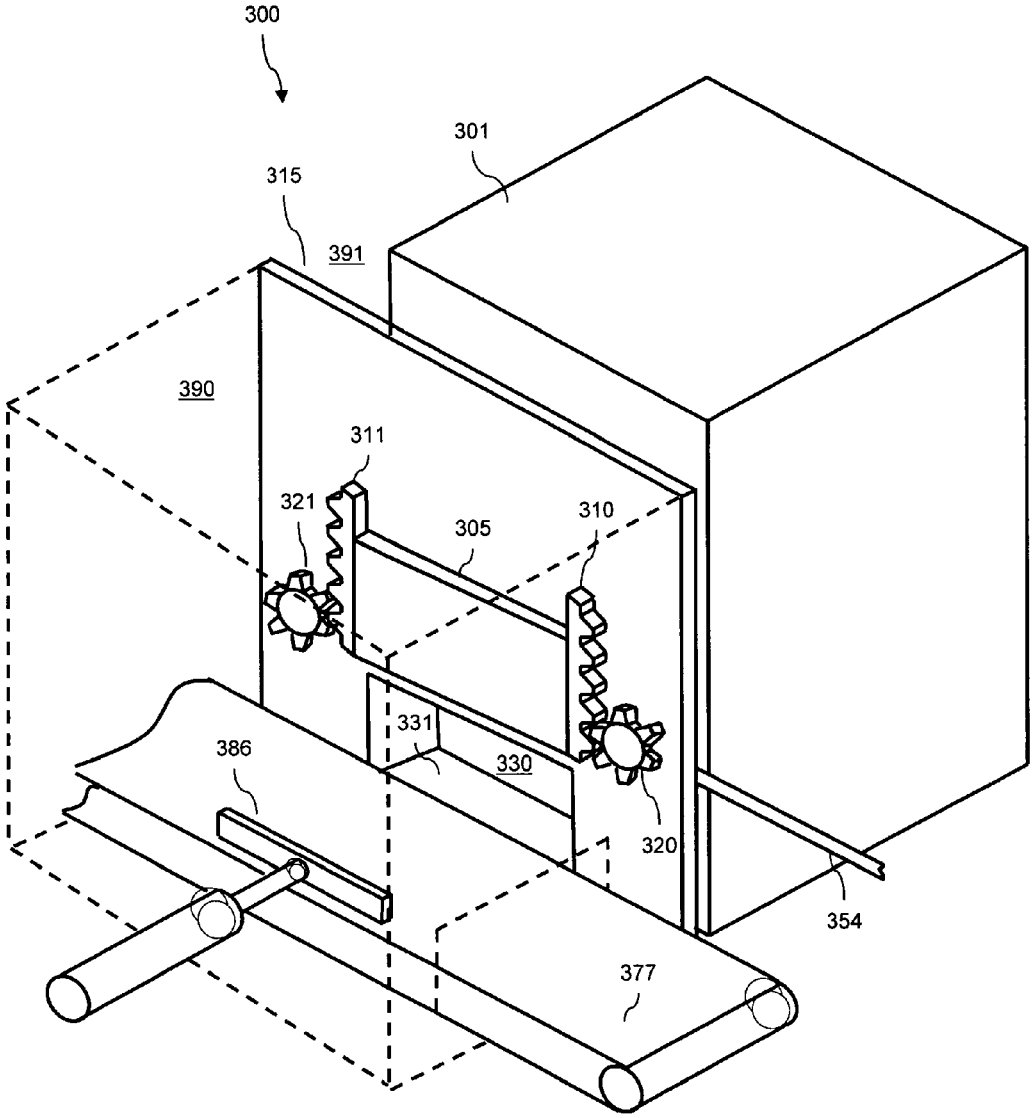
FIG. 3 is a schematic view of a freeze drying system in accordance with the present invention.

A freeze dryer system 300, including a vacuum chamber 301 and an aseptic region 390, is shown in FIG. 3. The aseptic area 390 contains the slot door 305 and opening 330 of the vacuum chamber 301, together with a loading mechanism including a conveyor 377 and a pusher 386 for pushing rows of vials onto shelves (not shown) in the chamber 301. The loading mechanism is designed to facilitate automated or manual sanitization. The aseptic area 390 and the non-aseptic area 391 are separated by a bezel or barrier 315. The bezel 315 is spaced apart from the chamber 301 by an extension 331 surrounding the opening 330.

Gear racks 310, 311 are mounted on either side of the slot door 305 to drive the door between the open position shown in FIG. 3 and a closed position. The pinions 320, 321 drive the racks 310, 311, respectively. The pinions are driven by a drive mechanism such as that described below with reference to FIG. 4. The drive mechanism includes a power drive shaft 354 that connects the mechanism to a motor (not shown). The drive mechanism is located on a non-aseptic side 391 of the bezel 315 and is therefore outside the aseptic area 390. The racks 310, 311, pinions 320, 321 and part of the pinion drive shafts (not shown) are exposed within the aseptic area 390 and are therefore easily sanitized by spraying. Guards (not shown) may cover those components within the aseptic area; if so, the guards are easily removable for manual sanitizing.

The pinion drive shafts pass through the isolating bezel 315 that separates the aseptic area 390 from the non-aseptic mechanical area 391 containing the pinion drive mechanism. The seals sealing the drive shafts to the bezel maintain aseptic conditions on the pinion end of the shafts despite exposure of the drive end of the shaft to non-aseptic conditions.

Figure 4:
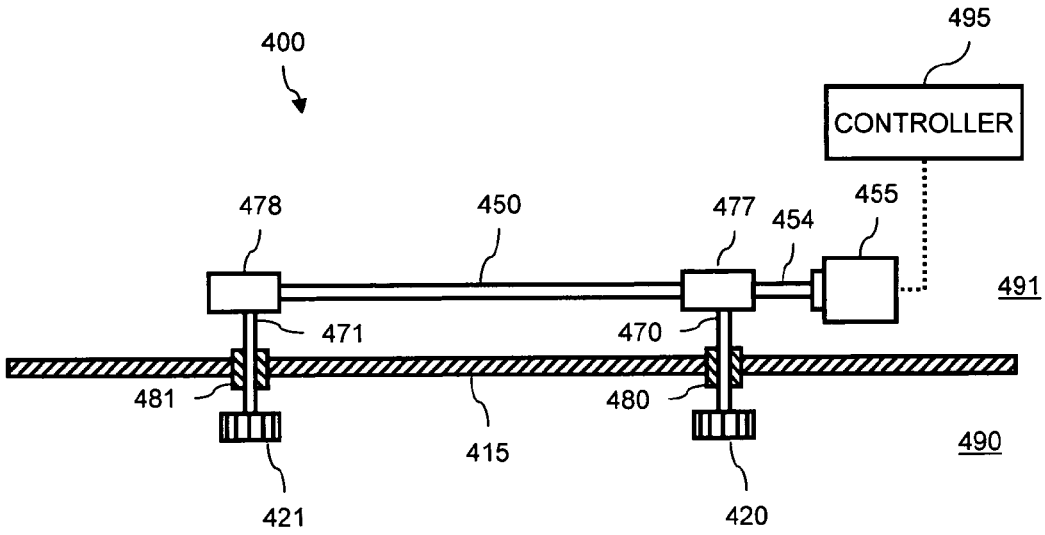
FIG. 4 is a schematic diagram showing a drive means in accordance with the present invention.

An exemplary pinion drive mechanism assembly 400 is shown in FIG. 4. The pinions 420, 421 are driven by drive shafts 470, 471, respectively. The drive shafts 470, 471 pass through seals 480, 481 in the bezel 415, separating an aseptic area 490 from a non-aseptic mechanical area 491. While the drive shafts are shown as separate elements from the pinions, the drive shafts may be integral with the pinions or may have a configuration different from that shown without departing from the scope of the present disclosure. The term "drive shaft," as used herein, includes separate shafts 470, 471 as shown, as well as any portion of the pinion or of any other component that rotates with the pinion, and that provides a sealing surface for the seals.

The drive shafts 470, 471 are driven by right angle drives 477, 478, respectively. The right angle drives 477, 478 are synchronized by a linking drive shaft 450 and are driven through a power drive shaft 454 by a motor 455. The motor 455, together with other components of the freeze drying system, may be controlled by a controller 495.

The right angle drives 477, 478 and the motor 455 each have internal components that are difficult or impossible to sanitize. Those components, however, are in the non-aseptic mechanical area 491 of the system, and are separated from the aseptic area 490 by the bezel 415 and seals 480, 481. In that way, those components may be utilized to drive the pinions, while only the easily sanitized pinions and racks are within the aseptic area 490.

Other pinion drive mechanisms, including but not limited to chain drive systems, separate hydraulic or electric servo motors, and belt drive systems, may be used without departing from the scope of the disclosure. Those drive mechanisms preferably include a timing scheme to assure that the pinions rotate together. In the case of pinions rotating on a common axis parallel with the plane of the door, a common drive shaft may be used, eliminating the need for a more complicated timing mechanism.

Figure 5:
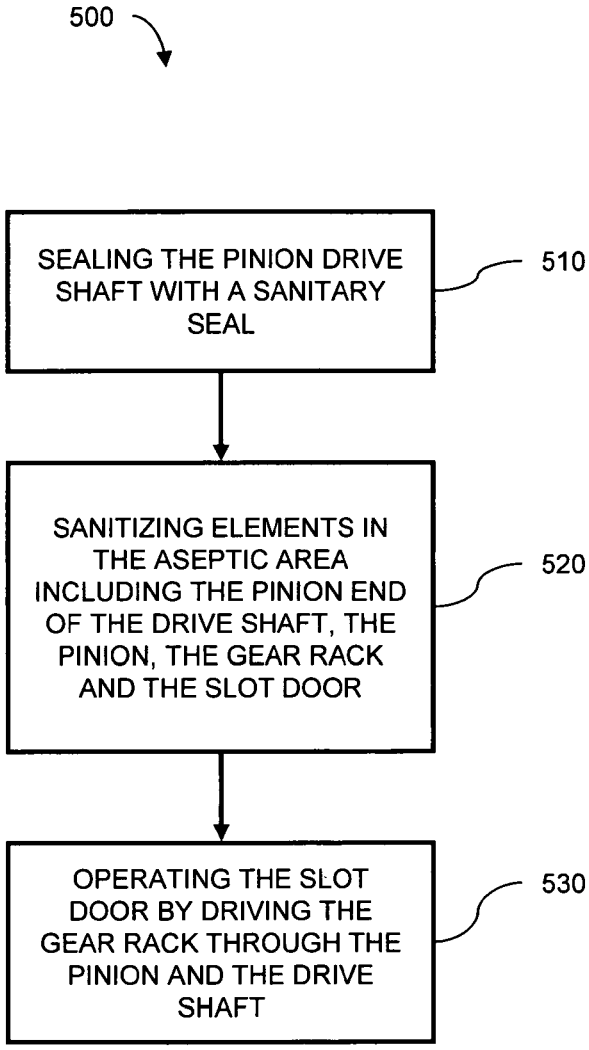
FIG. 5 is a flow chart showing a method in accordance with the present invention.

A method 500 for operating a slot door of a freeze drying chamber in an aseptic environment in accordance with one embodiment of the invention is illustrated by the flow chart of FIG. 5. The pinion drive shaft is sealed (step 510) with a sanitary seal. The seal keeps the pinion end of the drive shaft aseptic while the drive end of the drive shaft may be exposed to a non-aseptic environment. The seal creates a barrier between the pinion drive shaft and a component separating the aseptic and non-aseptic environments, such as the bezel 315 shown in FIG. 3.

Elements in the aseptic area are then sanitized (step 520). Those elements include the pinion end of the drive shaft, a pinion mounted on the pinion end of the drive shaft, a gear rack attached to the slot door and in engagement with the pinion, and the slot door. Those elements may be sanitized in an automated process wherein a sanitizing solution such as an isolator agent containing a vaporized hydrogen peroxide sterilant such as VHP® sterilant available from Steris Corporation of Mentor, Ohio, USA, is applied to the components in an isolator, or by applying a sanitizing agent such as bleach in a clean room environment. The open nature of a rack and pinion actuator facilitates the sanitizing process. In another embodiment, guards or guides installed over the rack and pinion actuator are manually removed before the sanitizing step. The sanitizing step may include manually applying a sanitizer, or exposing the components to a sanitizing gas or to steam, or irradiating the components.

The drive end of the drive shaft is then driven (step 530) to rotate the pinion, drive the rack and operate the slot door. Because the pinion drive shaft is sealed with a sanitary seal, the drive mechanism assembly need not be sanitized.

Methods of the present invention may be controlled or performed in part by an industrial controller or computer 495 (FIG. 4). The computer includes a central processing unit (CPU) and memory interconnected through a bus with input and output devices such as a man-machine interface, a network interface and interfaces with the freeze drying system for purposes known in the art such as initiating motion and receiving sensor data.

The memory may include random access memory (RAM), read-only memory (ROM) and various moveable and fixed memory drives. The memory stores data used during execution of a program in the CPU, and may be used as a work area. The memory furthermore functions as a program memory for storing a program. The program may reside on computer-usable medium as computer readable instructions stored thereon for execution by the CPU or another processor to perform the previously disclosed methods.

The foregoing Detailed Description is to be understood as being in every respect illustrative and exemplary, but not restrictive, and the scope of the invention disclosed herein is not to be determined from the Description of the Invention, but rather from the Claims as interpreted according to the full breadth permitted by the patent laws. It is to be understood that the embodiments shown and described herein are only illustrative of the principles of the present invention and that various modifications may be implemented by those skilled in the art without departing from the scope and spirit of the invention.

What is claimed is:

1. A freeze dryer system having an aseptic area and a non-aseptic area, the system comprising:

a vacuum chamber;

a slot door for providing access through an opening in the vacuum chamber by sliding between open and closed positions, the slot door being in the aseptic area in both the opened and closed positions;

at least one gear rack connected to the slot door, the at least one gear rack being exposed within the aseptic area of the system; and for each gear rack, a pinion engaged with the gear rack for driving the gear rack to move the slot door between the open and closed positions, the pinion being exposed within the aseptic area.

2. The freeze dryer system of claim 1, further comprising:

at least one pinion drive shaft for driving the at least one pinion in a rotary motion, each of the at least one pinion drive shafts passing through a rotary seal separating the aseptic area of the system from the non-aseptic area.

3. The freeze dryer system of claim 2, wherein the rotary seal comprises a lip seal.

4. The freeze dryer system of claim 1, further comprising:

a drive means connected for rotating the pinions, the drive means being in the non-aseptic region of the system.

5. The freeze dryer system of claim 4, wherein the drive means comprises:

one pinion drive shaft for driving each pinion;

first and second right angle drives coupled to respective pinion drive shafts;

a shaft coupling the right angle drives for synchronous rotation; and a motor coupled for driving the right angle drives.

6. The freeze dryer system of claim 1, further comprising:

an automatic sanitizing system for sanitizing at least the gear racks and pinions in the aseptic area.

7. The freeze dryer system of claim 6, wherein the automatic sanitizing system delivers a cleaning agent selected from the group consisting of: vaporized hydrogen peroxide, bleach and steam.

8. The freeze dryer system of claim 1, wherein the slot door is spaced apart from a wall of the vacuum chamber by an extension surrounding the opening.

9. The freeze dryer system of claim 8, further comprising:

a bezel mounted to the extension at an end of the bezel opposite the vacuum chamber wall, the bezel separating the aseptic and non-aseptic areas.

10. The freeze dryer system of claim 1, further comprising:

a loading mechanism positioned for loading product through the opening in the vacuum chamber, the loading mechanism being at least partially within the aseptic area.

11. The freeze dryer system of claim 1, further comprising:

guards positioned over the at least one gear rack and pinion, the guards being manually removable for sanitizing the gear and pinion.

12. A method for operating a slot door of a freeze drying chamber in an aseptic environment, the method comprising the steps of:

sealing a pinion drive shaft with a sanitary seal for keeping a pinion end of the pinion drive shaft aseptic while a drive end of the drive shaft is not aseptic;

sanitizing elements exposed within the aseptic environment, those elements including a pinion mounted on the pinion end of the pinion drive shaft, a gear rack attached to the slot door and in engagement with the pinion, and the slot door; and driving the drive end of the drive shaft to rotate the pinion, drive the gear rack and operate the slot door.

13. The method of claim 12, wherein the sanitizing step further comprises spraying a sanitizing agent on the elements of the freeze drying chamber.

14. The method of claim 13, wherein the sanitizing agent includes Vapor Hydrogen Peroxide (VHP).

15. The method of claim 13, wherein the sanitizing agent includes bleach.

16. The method of claim 12, wherein the sanitizing step further includes exposing the elements to steam.

17. The method of claim 12, wherein the step of sealing comprises applying a seal selected from the group consisting of a lip seal and a packing.

18. The method of claim 12, wherein the step of driving includes driving the drive end of the pinion shaft through a right angle drive.

19. A freeze dryer system, comprising:

a vacuum chamber having a vacuum chamber opening for loading product into the vacuum chamber;

a slot door mounted for substantially linear movement between an open position for loading product through the vacuum chamber opening and a closed position for sealing the vacuum chamber opening;

at least one gear rack connected to the slot door; and for each gear rack, a pinion engaged with the gear rack for driving the gear rack to move the slot door between the open and closed positions;

wherein each pinion has an axis of rotation substantially perpendicular to a principal plane of the slot door.

20. The freeze dryer system of claim 19, further comprising:

a loading mechanism positioned for loading product through the vacuum chamber opening.

21. The freeze dryer system of claim 19, further comprising:

at least one guard positioned over the at least one gear rack and pinion, the guards being removable for sanitizing the gear rack and pinion.

* * * * *